US007300358B2

(12) United States Patent
Noble

(10) Patent No.: US 7,300,358 B2
(45) Date of Patent: Nov. 27, 2007

(54) MULTIPLE FLEX SHAFT SYSTEM FOR GOLF CLUBS

(75) Inventor: Randall B. Noble, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 581 days.

(21) Appl. No.: 10/721,854

(22) Filed: Nov. 24, 2003

(65) Prior Publication Data

US 2005/0113183 A1 May 26, 2005

(51) Int. Cl.
*A63B 53/10* (2006.01)
*A63B 53/12* (2006.01)

(52) U.S. Cl. ..... 473/289; 473/409

(58) Field of Classification Search ..... 473/289, 473/409

See application file for complete search history.

(56) References Cited

U.S. PATENT DOCUMENTS 5,380,005 A * 1/1995 Hsu ..... 473/311
5,505,446 A 4/1996 Whitaker
5,944,616 A * 8/1999 Horwood et al. ..... 473/289
6,558,278 B2 * 5/2003 Bunn et al. ..... 473/409
6,729,970 B2 * 5/2004 Horwood et al. ..... 473/289

* cited by examiner

*Primary Examiner*—Stephen Blau
(74) *Attorney, Agent, or Firm*—Darrell F. Marquette

(57) ABSTRACT

The present invention relates to methods for optimizing the flexibility of each shaft comprised in a set of golf clubs. In general, based on a golfer's estimated swing speed, skill level and/or other relevant factors, an appropriate category of golf club shafts is selected. Each category of golf club shafts employ a unique range of shaft flexibility. The range of flexibility exhibited by categories of golf club shafts optimized for golfers with relatively higher swing speeds is greater than the range of flexibility exhibited by categories of golf club shafts optimized for golfers with relatively slower swing speeds. Similarly, the range of flexibility exhibited by categories of golf club shafts optimized for golfers of relatively higher skill levels is greater than the range of flexibility exhibited by categories of golf club shafts optimized for golfers of relatively lower skill levels.

1 Claim, 7 Drawing Sheets

MULTIPLE FLEX SHAFT SYSTEM FOR GOLF CLUBS

FIELD OF THE INVENTION

The present invention relates to golf clubs. More specifically, the invention relates to methods of optimizing the flexibility of a plurality of golf club shafts that comprise a set of golf clubs.

BACKGROUND OF THE INVENTION

It is well-known that golf clubs can be designed to suit the needs of a plurality of golfers, which span a broad range of skill levels. For example, golf club manufacturers have designed golf club heads for less skilled or practiced players to include, in some instances, a larger club face. Golf clubs that employ a relatively larger hitting area are often intended to minimize the unwanted effects of "miss-hits," which are more prevalent among less practiced or skilled players. In addition, golf clubs designed for less practiced or skilled players often employ an "offset" club head—especially for the low to mid-irons. An "offset" club head provides more time during a swing to square the club head to the ball just before impact, which increases the possibility of a straight ball flight.

Optimizing golf clubs to accommodate the needs of various skill levels has not been restricted to club head design. Indeed, golf club designers and manufacturers have devoted a considerable amount of time, money and effort to optimizing golf club shafts as well. In particular, shafts have been designed in ways to address certain characteristics that are prevalent among golfers of high, medium and low skill levels.

Specifically, it has been found that less practiced or skilled players often exhibit a relatively slower swing speed when compared to more skilled players. It is also well-known that golfers having relatively slower swing speeds may benefit from a more flexible shaft, whereas golfers having relatively higher swing speeds, typically, may benefit from using more rigid shafts. Shaft flex is a measurement of the amount to which a shaft will bend under a certain load. When a player swings a golf club, the mass of the club head and the velocity of the swing cause the shaft to flex. Shaft flex can play an important role in the trajectory and distance that a ball travels, as well as the "feel" that a golfer experiences when swinging a club and striking a ball.

In addition, shaft flex can influence the amount of control that a golfer may have over the relative direction that a golf ball travels. Specifically, more rigid golf club shafts have been found to provide golfers with relatively higher swing speeds with a greater level of control over their golf shots. More flexible golf club shafts, however, may enable less practiced or skilled players, or players with relatively slower swing speeds, to increase the velocity of the golf club head at ball impact. An increase in club head velocity, of course, may enable such golfers to hit the ball a greater distance. In light of the foregoing, golf club designers and manufacturers have, generally, designed and offered golf clubs having shafts with greater flexibility for golfers with slower swing speeds and shafts with lesser flexibility for golfers having higher swing speeds and greater skill levels.

Another golf club design factor is the loft of the club head. The loft of a club is typically defined as the angle between the face of the golf club and the center line of the hosel. A set of golf clubs typically includes one or more "woods," a set of irons, and wedges. The woods may include, for example, a driver (1-wood), 2-wood, 3-wood, 4-wood, 5-wood, 6-wood, 7-wood) or any combination thereof. Additionally, golf club manufacturers offer woods based upon the loft of the club, and do not always identify woods by numbers (e.g. 3-wood, 5-wood). Golf club irons often include 3 through 9 irons, and sometimes 1 and 2 irons. Wedges often include a pitching wedge, sand wedge, gap wedge and/or a lob wedge, and in recent years a variety of specialty wedges have been offered in the marketplace.

The loft of each wood, and the loft of each iron and wedge, typically, differ from one another in a set. For example, a driver always has a lower degree-loft than a 3-wood in a set of clubs, and a 3-wood will always have a lower degree-loft than a 5-wood in a set of clubs. Likewise, a 3-iron will always have a lower degree-loft than a 4-iron in a set of clubs, and a 4-iron will always have a lower degree-loft than a 5-iron in a set of clubs. The degree-loft affects the effective trajectory that can be imparted on a golf ball by the club. In general, the higher the loft of a club head, the higher the effective trajectory of the ball that has been struck by the club.

The different woods, irons, and wedges that comprise a set of clubs are designed to address a plurality of golf shots that may be needed or desired. Drivers, for example, are typically used to hit a golf ball as far as possible. Similarly, wedges are often used to hit a ball a short distance. For purposes of illustration only, the greater the degree of loft of a club, the lesser distance the ball will typically travel.

Until now, golf club designers have, typically, categorized shaft designs into two general categories: (i) shafts designed for drivers and/or woods; and (ii) shafts designed for irons and wedges. For years, golf club manufacturers have designed and specified shafts for drivers and woods to be, generally, more flexible when compared to iron and wedge shafts for the same set of clubs. As stated, the more flexible shafts may allow golfers to hit the ball further than would be possible with more rigid shafts, which is typically the purpose behind hitting a driver or wood.

Prior to the present invention, when golf club shafts were fitted for a particular golfer, regardless of the golfer's swing speed, one type of shaft (having a particular flexibility) was selected for the driver and woods, while a second type of shaft (having, most often, a lesser flexibility) was chosen for irons and wedges. This is consistent with the desire to employ greater shaft-flex in drivers and woods to hit the ball further. The additional variable of adding increased shaft-flex can also affect the accuracy of a golf club, depending of course upon the skill of the particular golfer.

The present invention teaches that optimal shaft flexibility cannot simply be divided into two general categories, i.e., one flexibility for drivers and woods, and a second for irons and wedges. In particular, the present invention teaches the entirely new and unique approach that each shaft used in a set of clubs may be optimized for each specific club by custom fitting the individual golfer for each club—depending upon the swing speed, skill level of the golfer, desired distance, and desired accuracy. Thus, each individual shaft in a set of golf clubs may each be individually custom fit and, further, the shafts will often represent a continuum of flexibilities. Still further, the present invention teaches that the nature of this continuum of flexibilities will, preferably, be different among golfers of low, medium and high skill levels and/or having slow, medium or high swing speeds.

SUMMARY OF THE INVENTION

The present invention relates to methods for optimizing the flexibility of each shaft that comprises a set of golf clubs. In a first preferred embodiment, the approximate swing speed of the golfer for which the golf club shafts will be optimized is preferably determined. Based on the golfer's estimated swing speed, an appropriate category of golf club shafts is preferably selected from two or more categories. Each category of golf club shafts preferably employ a unique range of shaft flexibility. In general, the range of flexibility exhibited by categories of golf club shafts optimized for golfers with relatively higher swing speeds is greater than the range of flexibility exhibited by categories of golf club shafts optimized for golfers with relatively slower swing speeds.

In a second preferred embodiment, the approximate skill level of the golfer for which the golf club shafts will be optimized is preferably determined. Based on the golfer's estimated skill level, an appropriate category of golf club shafts is preferably selected from two or more categories. Each category of golf club shafts preferably employ a unique range of shaft flexibility. The range of flexibility exhibited by categories of golf club shafts optimized for golfers of relatively higher skill levels is greater than the range of flexibility exhibited by categories of golf club shafts optimized for golfers of relatively lower skill levels.

In a third preferred embodiment, the present invention provides a set of golf clubs, which preferably comprise a set of shafts that exhibit a range of flexibility. The range of flexibility for any given set of golf club shafts is optimized in accordance with the methods described herein.

DETAILED DESCRIPTION OF THE INVENTION

The following will describe in detail several preferred embodiments of the invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used and made without departing from the scope and spirit of the invention.

The present invention relates to methods for optimizing the flexibility of each shaft that is used in a set of golf clubs. In a first preferred embodiment, the approximate swing speed of the golfer for a particular golf club or set of clubs will be determined. There are several methods well-known in the art that can be used to measure the approximate swing speed of a golfer. Based on the golfer's estimated swing speed for a particular club or set of clubs, an appropriate category of golf club shafts is selected from two or more categories.

Each of the two or more categories of golf club shafts, preferably, employ a unique range of shaft flexibility. The range of flexibility exhibited by categories of golf club shafts optimized for golfers with high swing speeds will, generally, be greater than the range of flexibility exhibited by categories of golf club shafts optimized for golfers with relatively slower swing speeds. The present invention may employ an unlimited number of categories of shafts, wherein each category of shafts is considered to be optimized for a specific range of swing speeds. That is, one embodiment of the present invention provides for two categories of shafts to be considered when optimizing shaft flexibility for a set of shafts, wherein one category is, for example, appropriate for golfers with "high swing speeds" and the other optimized for golfers with "medium and low swing speeds." Alternatively, by way of example only, another embodiment of the present invention provides that as many as fifty (50) categories of shafts may be considered when optimizing shaft flexibility for a set of shafts, wherein one category is appropriate for golfers having swing speeds of 70 miles per hour (m.p.h.) or below, another category for golfers having swing speeds between 70–71 m.p.h., another for 71–72 m.p.h., and so on; up to swing speeds of 120 m.p.h. or above. In sum, the invention is not limited to any number of categories of shafts for a set of clubs, rather, any number of categories of shafts can be used. What's important, however, is that the range of flexibility exhibited by the sets of shafts that comprise each category may increase in relation to the swing speeds for which each category is optimized, wherein the range of flexibility accorded to each category increases as the corresponding swing speeds for which such categories of shafts are optimized increase.

Figure 1:
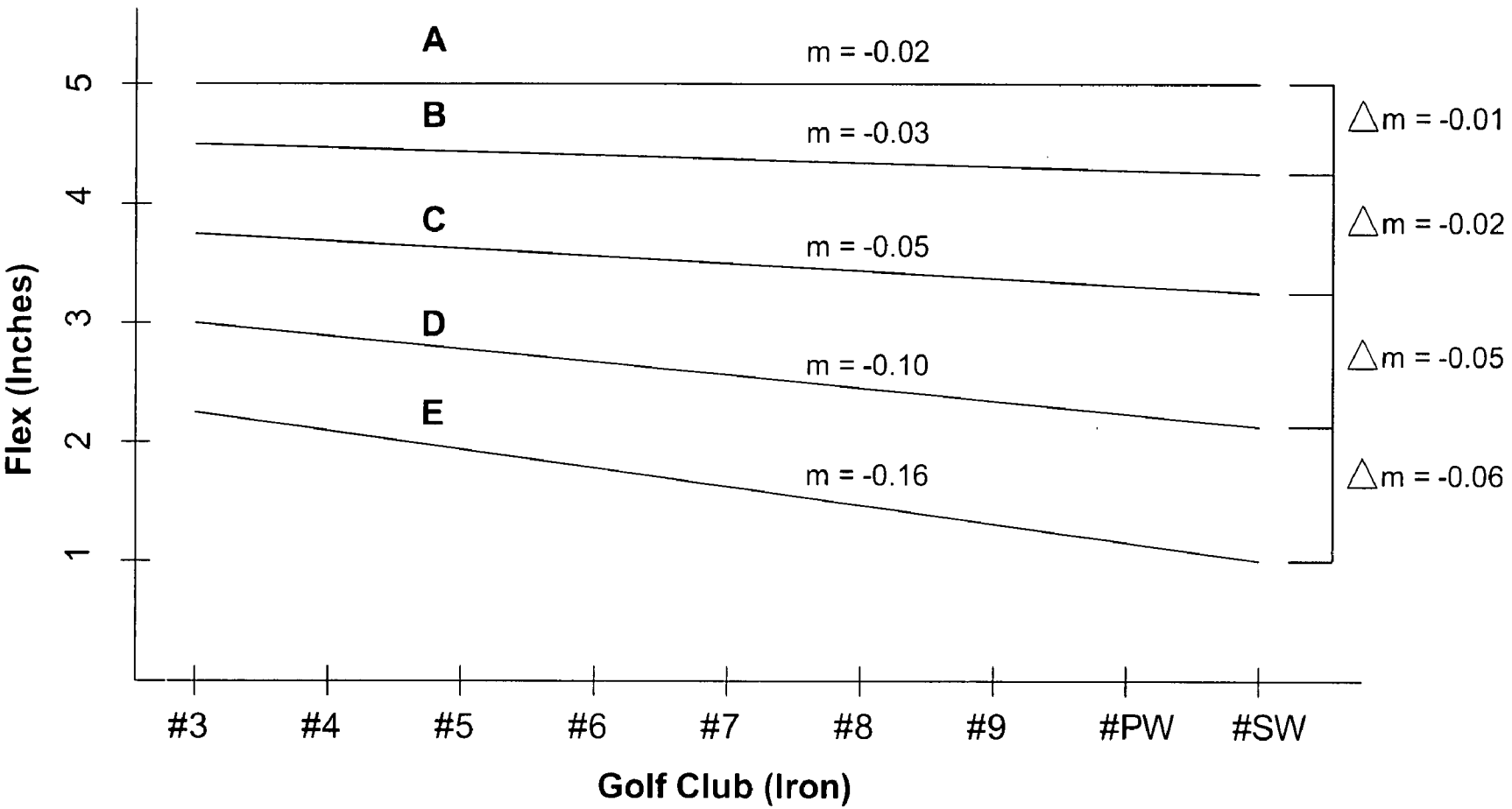
FIG. 1: Chart summarizing one of the preferred embodiments of the present invention, wherein the range of flexibility exhibited by a plurality of shafts that comprise each of a plurality of categories of shafts vary, wherein the amount of such variability in range of flexibility among the several categories is irregular.
Figure 2:
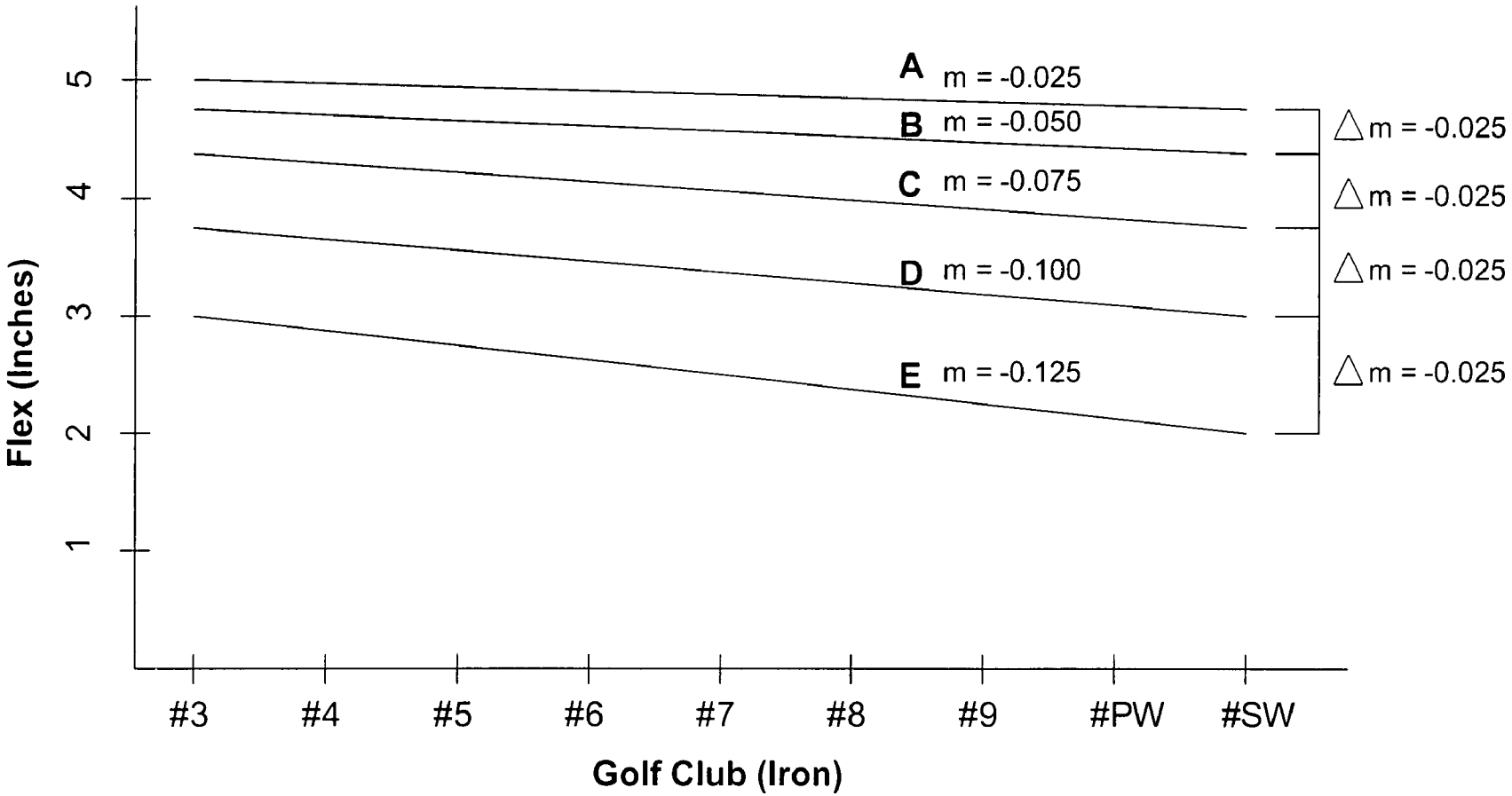
FIG. 2: Chart summarizing one of the preferred embodiments of the present invention, wherein the range of flexibility exhibited by a plurality of shafts that comprise each of a plurality of categories of shafts vary, wherein the amount of such variability in range of flexibility among the several categories is consistent.

The difference in the range of flexibility exhibited by the sets of shafts that comprise each category of the invention, in one preferred embodiment, may be consistent or irregular. To illustrate this point, FIGS. 1 and 2 show a plurality of sets of golf club shafts that are, preferably, optimized for at least five (5) different swing speeds. In each example, the variance in flexibility among the shafts that comprise each category is consistent, i.e., the variance in flexibility among the several shafts that comprise each category is linear. Thus, the range of flexibility exhibited by the several sets of shafts, which consist of the same amount and type of clubs, that comprise each category can be estimated in FIGS. 1 and 2, for example, by calculating the approximate slope ("m") of each line shown therein. Of course, the absolute value of the slope ("m") values accorded to each category can be compared to ascertain the relative difference in range of shaft flexibility exhibited by the several categories. Alternatively, those skilled in the art will appreciate that the range of flexibility exhibited by the several shafts that comprise each category can be estimated by simply calculating the difference in flex between the clubs of a set having the lowest and highest loft.

In FIG. 1, the range of flexibility exhibited by each set of shafts that comprise the five different categories varies. That is, the range of flexibility exhibited by each category of shafts, which is represented by the slope ("m") value, is not the same. As shown in FIG. 1, the estimated range of flexibility for category A is represented by a slope of m=−0.02; whereas, for example, the estimated range of flexibility for category D is represented by a slope of m=−0.10. Thus, the several categories of golf club shafts shown in FIG. 1 do not exhibit the same range of flexibility within each category.

As stated, the difference in the range of flexibility exhibited by the sets of shafts that comprise each category of the invention, in one preferred embodiment, may be consistent or irregular. In FIG. 1, for example, the difference in the range of flexibility between category A and B is shown to be approximately "Δm=−0.01," whereas the difference in range of flexibility between category C and D is estimated to be "Δm=−0.05." Thus, in FIG. 1, the difference in the range of flexibility exhibited by each category of shafts is irregular. It should be appreciated by those skilled in the art that the difference in the range of flexibility exhibited by the several categories of shafts could, alternatively, be consistent. FIG. 2 provides a non-limiting example of such an embodiment, wherein the range of flexibility exhibited by each set of shafts that comprise the five different categories varies as represented by the different slope ("m") values, wherein this variability is consistent among the five categories of shafts as represented by the same Δm values.

Still further, the variance in flexibility among the shafts that comprise any given category of shafts may be consistent or irregular. For example, the amount of difference in shaft flexibility between the 3-iron and 4-iron, the 4-iron and 5-iron, and so on may be substantially the same, or, alternatively, the amount of difference in shaft flexibility between the various shafts that form a set or irons, for example, may be different. The variance in flexibility among the shafts that comprise each of the categories of shafts shown in FIGS. 1 and 2, for example, is consistent. Thus, as described earlier, the range in flexibility among the plurality of shafts that comprise each category of shafts can be linearly represented.

Figure 3:
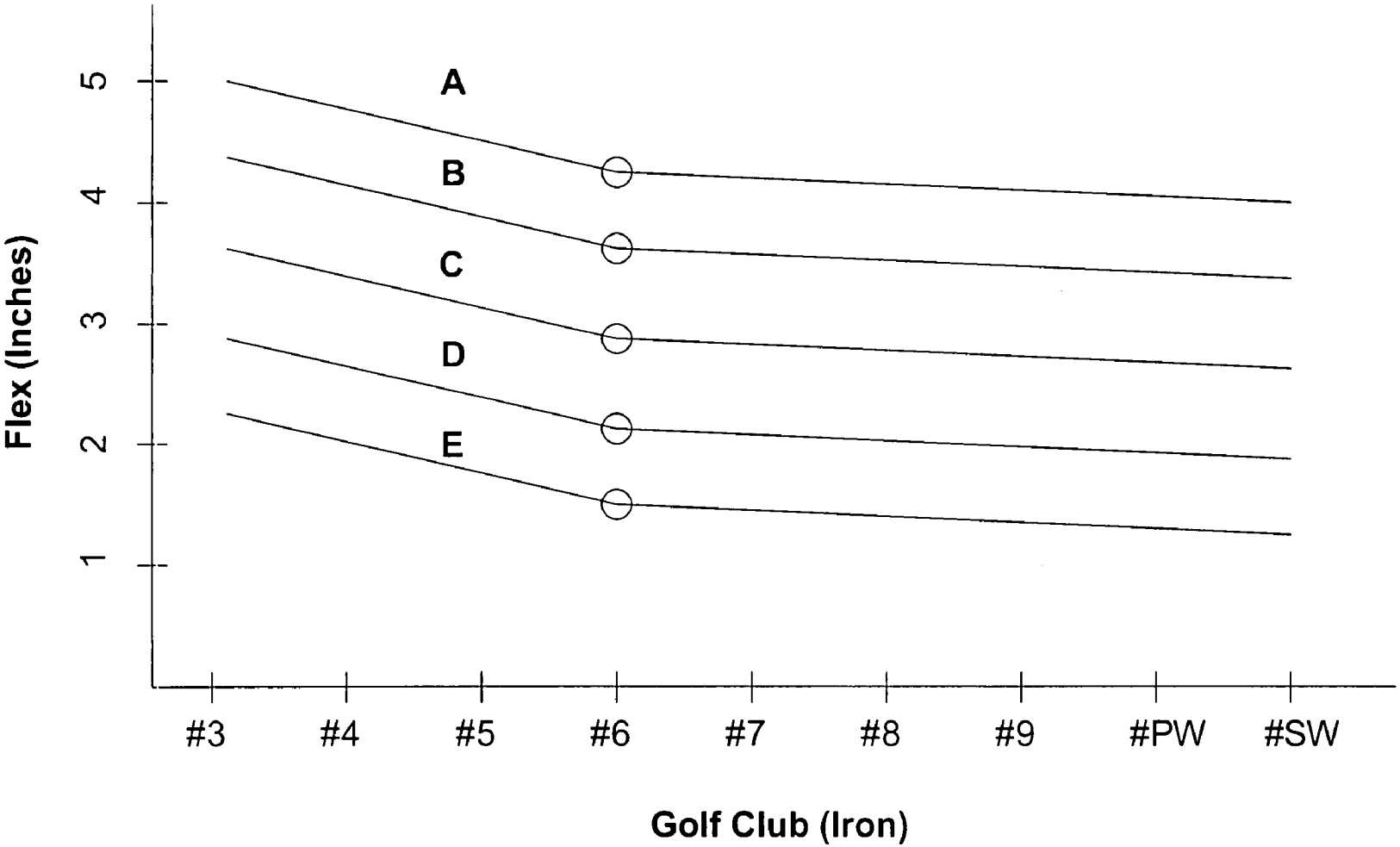
FIG. 3: Chart summarizing one of the preferred embodiments of the present invention, wherein the variance in shaft flexibility among the several shafts that comprise each category is irregular.

The present invention further provides that the variance in shaft flexibility among the several shafts that comprise each category may be irregular. For example, the difference in shaft flexibilities, if any, among the "short-irons" may be more subtle than the difference in shaft flexibilities among the "long-irons." By way of example only, FIG. 3 illustrates five categories of shafts that exhibit such characteristics. In this embodiment, the variance in flexibility among the several respective shafts that comprise each category may be consistent or irregular. For example, the amount of difference in shaft flexibility among the 3-, 4-, 5- and 6-irons shown in FIG. 3 is substantially the same for categories A through E.

Figure 4:
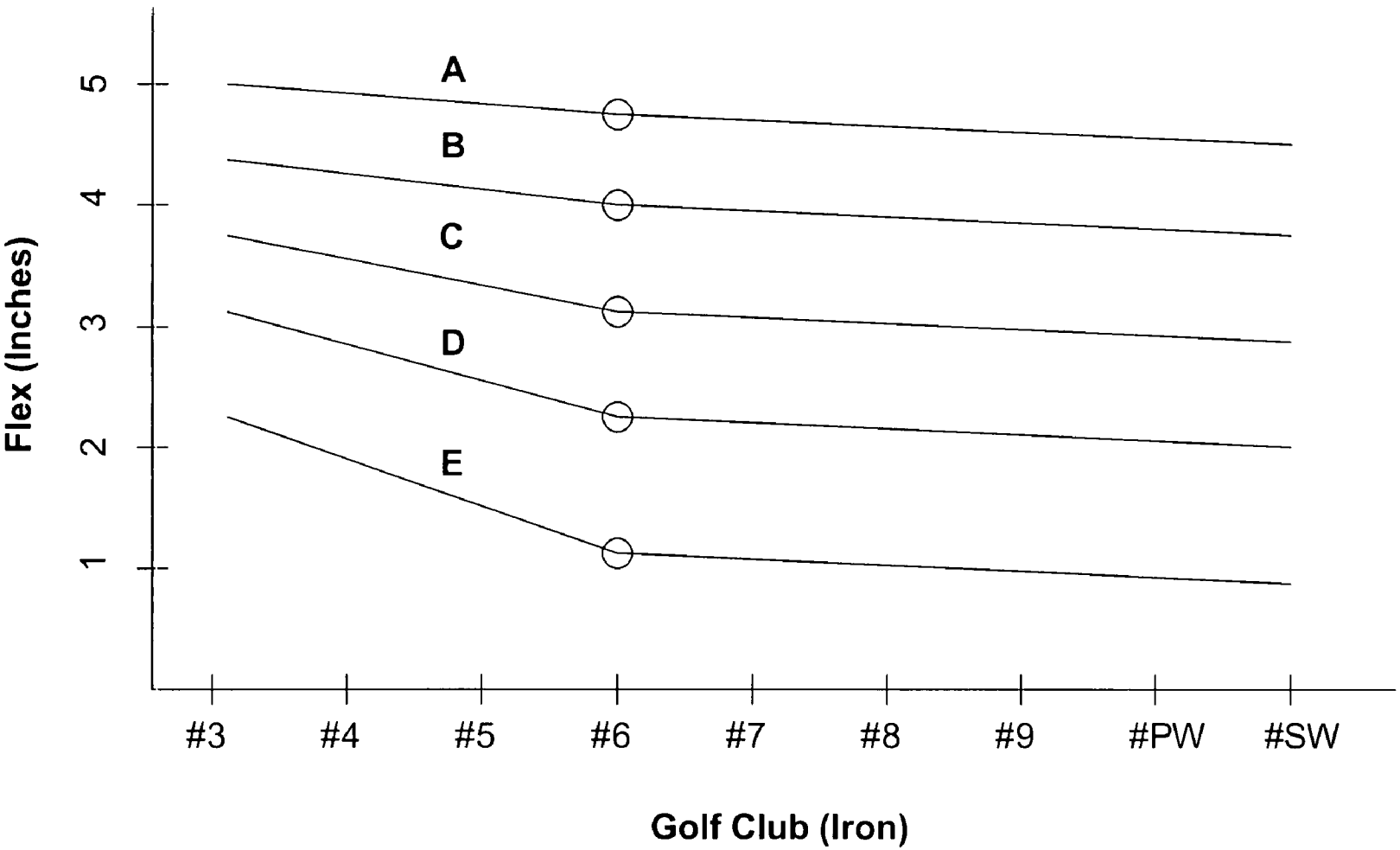
FIG. 4: Chart summarizing one of the preferred embodiments of the present invention, wherein the variance in shaft flexibility among the several shafts that comprise each category is irregular, wherein the variance in shaft flexibility between respective golf clubs of two or more categories also varies.

Alternatively, however, the difference in shaft flexibility among respective clubs of two or more categories may be irregular. As shown in FIG. 4, for example, the difference in shaft flexibility among the 3-, 4-, 5- and 6-irons for category A is significantly less than the difference among the same irons for category E. Consistent with other preferred embodiments described herein, the range of flexibility exhibited by the sets of shafts that comprise each category will, preferably, increase in relation to the swing speeds for which each category is optimized, wherein the range of flexibility accorded to each category increases as the corresponding swing speeds for which such categories of shafts are optimized increase.

Figure 5:
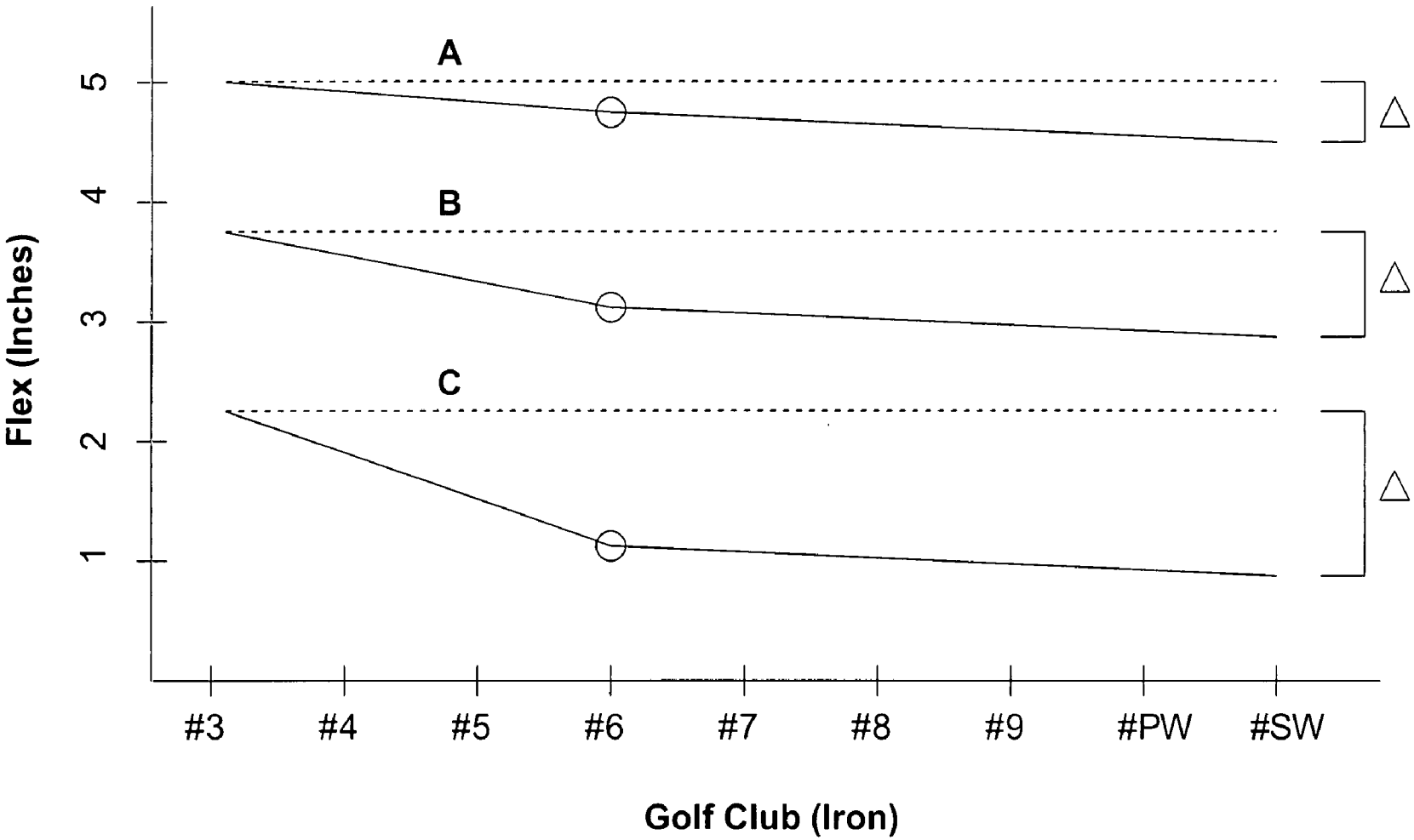
FIG. 5: Chart illustrating a method by which the estimated range of flexibility exhibited by a plurality of shafts that comprise a category of shafts can be calculated.

When the variance in shaft flexibility among the several shafts that comprise each category is irregular, the range of flexibility for each category can be estimated by simply calculating the difference in flex between the clubs having the lowest and highest loft, e.g., between the 3-iron and wedge, the 1-iron and wedge, the driver (1-wood) and wedge, etc. FIG. 5 illustrates this non-limiting example of how one skilled in the art may estimate the range of flexibility exhibited by several shafts that comprise a category of shafts.

Figure 6:
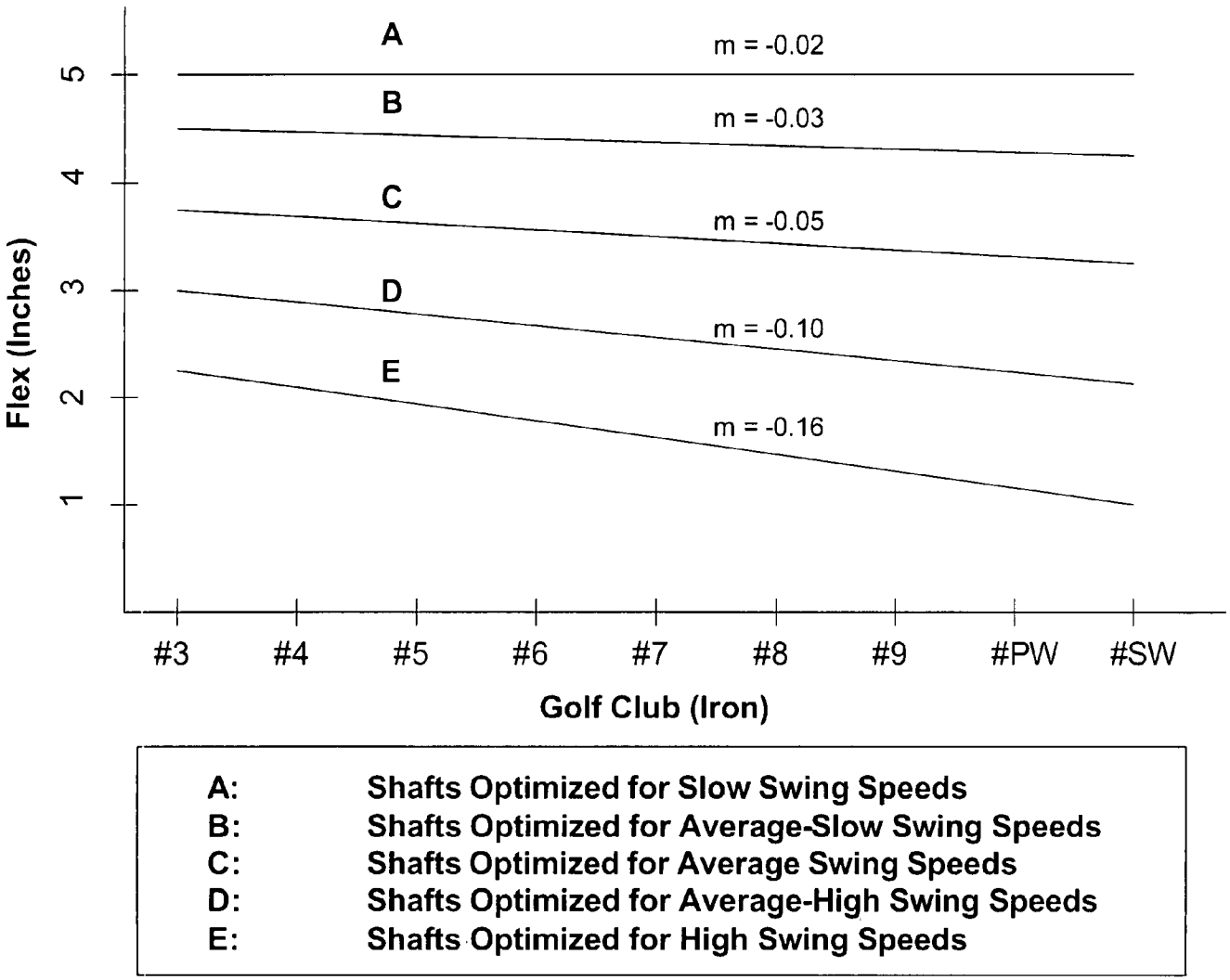
FIG. 6: Chart summarizing one of the preferred embodiments of the present invention, which illustrates five categories of shafts that are, preferably, optimized for golfers with different swing speeds.

FIG. 6 provides a non-limiting example of another embodiment of the present invention in which five categories of shafts may be optimized for golfers who are capable of the various swing speeds shown therein. Consistent with the foregoing, the range of flexibility exhibited by the set of shafts shown in FIG. 6 to be optimized for golfers with high swing speeds, identified as "E," is greater than the range of flexibility exhibited by the category of shafts shown to be optimized for average swing speeds, identified as "C." Likewise, the range of flexibility exhibited by the category of shafts shown in FIG. 6 to be optimized for golfers with average swing speeds is greater than the range of flexibility exhibited by the category of shafts shown to be optimized for slow swing speeds, identified as "A." Still further, FIG. 6 shows two intermediate levels of swing speeds, labeled "average-slow" and "average-high" swing speeds, or "B" and "D," respectively.

The various categories of swing speeds presented in FIG. 6 are identified as such for purposes of illustration only. Of course, those skilled in the art may simply categorize various swing speeds numerically. For example, swing speeds of 110 miles per hour ("m.p.h.") or higher may be considered "high," swing speeds ranging from 100–110 m.p.h. may be considered "average-high," swing speeds ranging from 90–100 m.p.h. may be considered "average," swing speeds ranging from 80–90 m.p.h. may be considered "average-slow," and swing speeds below 80 m.p.h. may be considered "slow."

In another preferred embodiment, the present invention provides methods of optimizing sets of shafts, wherein the relative skill level of each golfer for which any given set of golf club shafts will be optimized is considered. There are several methods well-known in the art to measure the approximate skill level of a golfer. A non-limiting example may involve the handicap system developed and managed by the United States Golf Association ("USGA"). For example, golfers with handicaps at or below 6 may be considered "highly skilled," golfers with handicaps between 6 and 13 may be considered "average to highly skilled," golfers with handicaps between 13 and 28 may be considered "average to below-average," and golfers with handicaps greater than 28 may be considered "below-average." Furthermore, in custom fitting a golfer, the individual golfer may be evaluated for their specific skill and performance level—whether overall, or club by club.

Based on the golfer's estimated skill level, in one preferred embodiment of the present invention, an appropriate category of golf club shafts may be selected from two or more categories. Each category of golf club shafts employ a unique range of shaft flexibility, as described above. The range of flexibility exhibited by categories of golf club shafts optimized for golfers of high skill levels, generally, is greater than the range of flexibility exhibited by categories of golf club shafts optimized for golfers of relatively lower skill levels.

Figure 7:
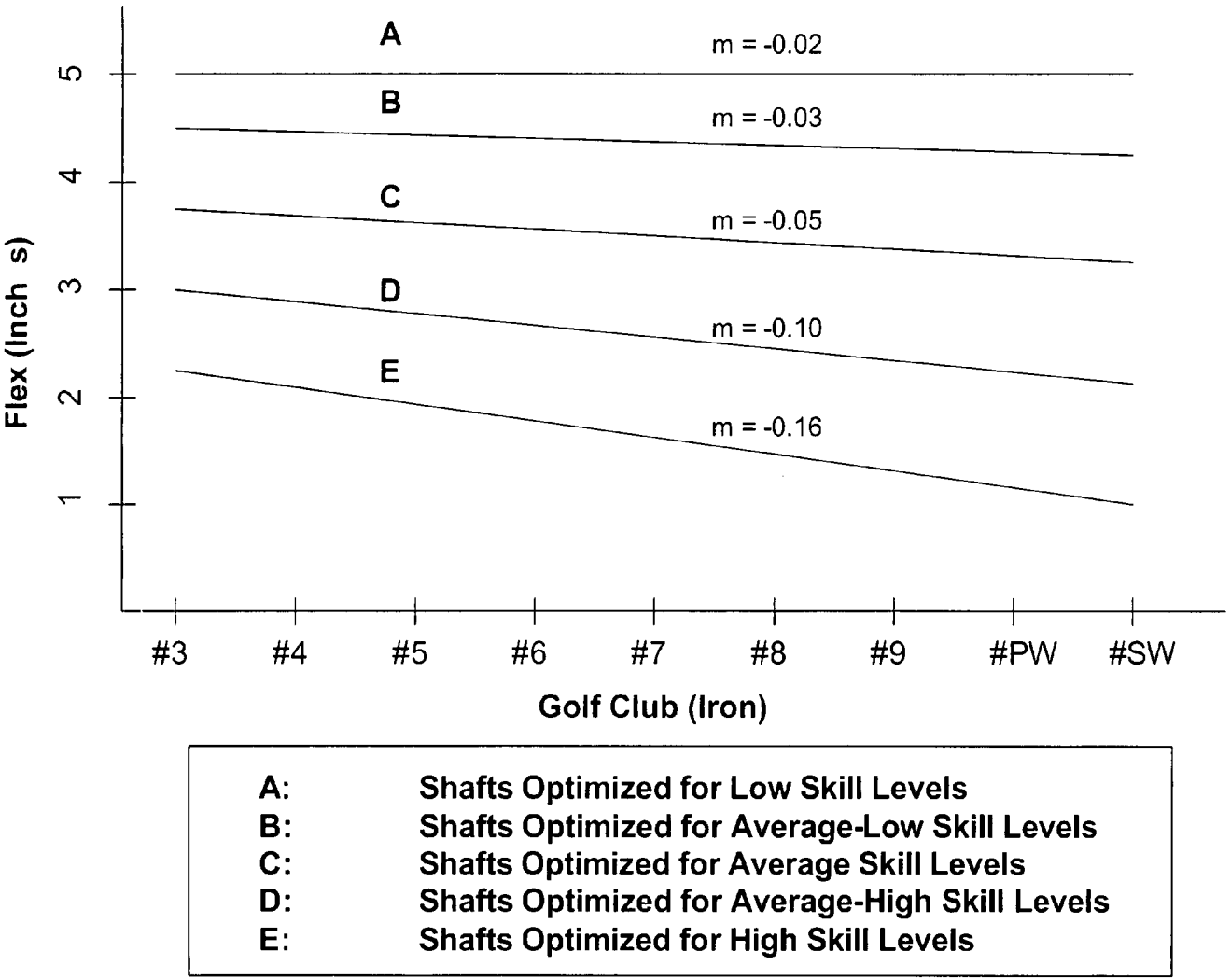
FIG. 7: Chart summarizing one of the preferred embodiments of the present invention, which illustrates five categories of shafts that are, preferably, optimized for golfers of different skill levels.

Of course, this embodiment will also employ an unlimited number of categories of shafts that are optimized for a plurality of skill levels. FIG. 7 illustrates a non-limiting example of such categories. Consistent with the foregoing, the range of flexibility exhibited by the category of shafts shown in FIG. 7 to be optimized for golfers of high skill levels, identified as "E," is greater than the category of shafts shown to be optimized for average skill levels, identified as "C." Likewise, the range of flexibility exhibited by the category of shafts shown in FIG. 7 to be optimized for golfers of average skill levels is greater than the category of shafts shown to be optimized for low skill levels, identified as "A." Still further, FIG. 7 shows two intermediate skill levels, labeled "average-low" and "average-high" skill levels, or "B" and "D," respectively. Thus, it should be clear to those skilled in the art that this embodiment of the present invention encompasses an unlimited number of categories of shafts, which may be optimized for a plurality of skill levels.

In a further preferred embodiment, the present invention provides methods of optimizing sets of shafts as described above, wherein a plurality of factors related to each golfer for which any given set of shafts may be optimized are considered. Such factors may comprise, preferably, each golfer's swing speed and skill level. The plurality of factors, of course, may further include each golfer's height, age, gender, preferred shaft composition, length and diameter, and any other factors known in the art that may be considered when designing golf club shafts.

In addition to optimizing the range of flexibility exhibited by each category of shafts, the present invention, preferably, in several embodiments, provides methods of identifying the appropriate levels of flex over which the optimum range of flexibility should span. The levels of flex over which the optimum range of flexibility may span for golfers with relatively higher swing speeds will, generally, be lower than the levels of flex over which the optimum range of flexibility may span for golfers with relatively slower swing speeds. FIG. 6 illustrates this trend. For example, the levels of flex over which the set of shafts shown in FIG. 6 to be optimized for golfers with high swing speeds, identified as "E," spans from approximately 2.2 to 1.0 Inches, whereas the category of shafts shown to be optimized for average swing speeds, identified as "C," spans from 3.6 to 3.2 Inches. Thus, the levels of flex over which category E spans are lower than the levels of flex over which category C spans.

Similarly, the levels of flex over which the optimum range of flexibility may span for golfers of relatively higher skill are, generally, lower than the levels of flex over which the optimum range of flexibility may span for golfers of relatively lower skill. For example, the levels of flex over which the set of shafts shown in FIG. 7 to be optimized for golfers of relatively high skill, identified as "E," spans from approximately 2.2 to 1.0 Inches, whereas the category of shafts shown to be optimized for golfers of average skill, identified as "C," spans from 3.6 to 3.2 Inches. Thus, the levels of flex over which category E spans are lower than the levels of flex over which category C spans. It should be apparent to those skilled in the art that any of the unlimited number of categories of shafts described herein, which may be optimized for any of a plurality of golfers, may adhere this trend, or, alternatively, may not. In short, the preferred embodiments of the present invention do not require that the two or more categories of shafts described herein follow this trend without exception.

The preferred embodiments described herein may be applied to optimize any number of shafts for an entire set of clubs, or, alternatively, for less than an entire set of clubs. For example, the methods described herein may be applied to optimize the shafts that may comprise the following: (i) driver, 3-wood and 3-iron through 5-iron; (ii) 3-iron through sand wedge; or (iii) any combination of clubs that may comprise at least a part of a set of clubs.

In various preferred embodiments described herein, the range of flexibility exhibited by the sets of shafts that comprise each category, generally, increase in relation to the swing speeds and/or skill levels for which each category is optimized, wherein the range of flexibility accorded to each category increases as the corresponding swing speeds and/or skill levels for which such categories of shafts are optimized increase. It should be apparent to those skilled in the art that the foregoing trend may be applied to any range of shaft flexibility. In FIGS. 1–7, for example, the general range of flexibility within which the several categories of shafts exist is limited to 0–5 Inches. This general range is provided only to illustrate the preferred embodiments of the present invention. The general range of flexibility within which two or more categories of shafts exist may span less than 5 Inches, or, alternatively, more than 5 Inches. Furthermore, the relative flexibility of each shaft that comprises each category of shafts can be measured using any method and metric known in the art.

Still further, the present invention provides sets of golf clubs that include a plurality of shafts that exhibit a range of flexibility, which are optimized in accordance with the methods and embodiments described herein. For example, the present invention provides golf club shafts that are optimized for (i) any of a plurality of swing speeds, (ii) golfers exhibiting any of a plurality of skill levels, or (iii) golfers exhibiting any specific combination of skill and swing speed.

Of course, the golf club shafts described and claimed herein can be made of steel, graphite, steel and graphite, or any other composition by itself or in combination with others known in the art to be useful in producing and/or designing golf club shafts. Furthermore, the shafts described and claimed herein can be manufactured and/or mass produced using any method known in the art today or discovered hereafter.

The many aspects and benefits of the invention are apparent from the detailed description, and thus, it is intended for the following claims to cover all such aspects and benefits of the invention which fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A method for optimizing the flexibility of each golf club shaft in a set of golf clubs, wherein the method comprises the steps of:

(i) determining the relative swing speed of the golfer for which the golf club shafts will be optimized; and (ii) selecting the appropriate category of golf club shafts from a plurality of categories, wherein the range of shaft flexibility exhibited by a category of golf club shafts optimized for golfers with relatively high swing speeds is greater than the range of flexibility exhibited by a category of golf club shafts optimized for golfers with relatively lower swing speeds, and wherein the variance in shaft flexibility exhibited by the plurality of shafts that comprise each category is consistent.

* * * * *